United States Patent [19]

Connors

[11] 4,043,087

[45] Aug. 23, 1977

[54] METHOD AND MEANS FOR SUPPORTING AN ELEVATED CONCRETE WALL PANEL FORM

[75] Inventor: Frank T. Connors, Deerfield, Ill.

[73] Assignee: Symons Corporation, Des Plaines, Ill.

[21] Appl. No.: 638,642

[22] Filed: Dec. 8, 1975

[51] Int. Cl.[2] ..... E04G 11/08

[52] U.S. Cl. ..... 52/127; 52/266; 52/743; 249/20; 264/33

[58] Field of Search ..... 264/33; 52/127, 105, 52/741, 749, 743, 266; 249/20; 85/3 R

[56] References Cited

U.S. PATENT DOCUMENTS

| | | | |
|---|---|---|---|
| 947,160 | 1/1910 | Newerf | 249/22 X |
| 976,960 | 11/1910 | Weber | 249/22 |
| 1,410,042 | 3/1922 | Watt | 85/3 R |
| 1,617,746 | 12/1927 | Denger | 249/20 X |
| 1,963,514 | 6/1934 | Wherren | 249/20 X |
| 2,578,515 | 12/1951 | Crafton | 85/3 R |
| 2,719,347 | 10/1955 | Brekke | 249/22 |
| 3,224,065 | 12/1965 | Cheskin | 249/20 X |
| 3,252,199 | 5/1966 | Bossner | 52/743 X |
| 3,399,505 | 9/1968 | Comment | 52/743 |
| 3,588,026 | 6/1971 | Williams | 249/20 X |
| 3,628,223 | 12/1971 | Babee | 264/33 |
| 3,638,901 | 2/1972 | Williams | 249/20 |

FOREIGN PATENT DOCUMENTS

| | | | |
|---|---|---|---|
| 55,677 | 11/1920 | Sweden | 249/20 |
| 835,756 | 5/1960 | United Kingdom | 249/20 |

*Primary Examiner*—Leslie Braun
*Attorney, Agent, or Firm*—Norman H. Gerlach

[57] ABSTRACT

Method and means for supporting an elevated concrete wall panel form, wherein a bolt member is removably inserted through a first concrete wall panel to extent horizontally therethrough and project axially from opposite sides thereof, whereby a wall of a form for a second concrete wall panel in superposed relation to the first panel may be seated on one projecting end of the bolt member and the bolt member is rendered accessible from its opposite end, and the seated form wall is secured between the first wall panel and a retaining member projecting laterally from said one end of the bolt member, the retaining member being mounted on the bolt member for disposition permitting withdrawal of the bolt member through the first wall panel and from said opposite end of the bolt member after forming a second wall panel.

9 Claims, 17 Drawing Figures

METHOD AND MEANS FOR SUPPORTING AN ELEVATED CONCRETE WALL PANEL FORM

BACKGROUND OF THE INVENTION

This invention relates to a method and means for supporting an elevated concrete wall panel form, more particularly, for supporting a wall panel form on a first wall panel for erection of a second wall panel in superposed relation to the first panel.

In the construction of multi-story buildings, it has been the practice for forming wall panels in successive "lifts" to support a form or form gang on shear wall brackets or the like which are secured on the outside of the structure to a wall panel beneath the panel being formed. A disadvantage of the present practice is that installation of a shear wall bracket frequently is difficult, in that, for example, a man must hang over a wall holding a heavy bracket in one hand while he endeavors to install a threaded bolt with the other hand. A major disadvantage concerns the removal of a bracket from the outer surface of a wall panel after another panel has been formed thereabove and when the form is removed. The bracket is removed by a man in a bosun chair, hanging scaffold, or other support, after the form is stripped and moved. To avoid this additional operation, a contractor may elect to have a man remove the bracket while the man is on the form and the form or form gang is supported only by ties at the top of the form and/or by crane cable lines, which is a hazardous operation.

It would be desirable to support the form safely on supporting members of wall brackets while the form ties are being broken by a man on the form, and to remove the supporting members only after the man is off of the form, and from inside of the building, thereby eliminating the need for an additional operation outside of the building or the unsafe practice of working from a suspended form. It would be desirable also to provide for the installation of at least the supporting members of wall brackets from inside of the building, to make the installation of the brackets simpler and faster.

SUMMARY OF THE INVENTION

The invention provides a method and means for supporting the elevated concrete wall panel form, wherein a bolt member is removably inserted through a first concrete wall panel to extend horizontally therethrough and project axially from opposite sides thereof, whereby a wall of a form for a second concrete wall panel in superposed relation to the first panel may be seated on one projecting end of the bolt member and the bolt member and the bolt member is rendered accessible from its opposite end, and the seated form wall is secured between the first wall panel and a retaining member projecting laterally from said one end of the bolt member, the retaining member being mounted on the bolt member for disposition permitting withdrawal of the bolt member through the first wall panel and from said opposite end of the bolt member after forming a second wall panel.

Support means pursuant to the invention include, more particularly, a first concrete wall panel and shear wall bracket structure adapted to be mounted thereon for supporting an elevated concrete wall panel form. The invention also provides improved shear wall brackets.

An important increase in safety is achieved employing the method and means of the invention. In particular, bracket support for a form or form gang may be maintained until the form is clear of workmen, so that the workmen need not rely for their safety only on ties or cables. In the preferred embodiments of the invention, the form may be both supported and firmly clamped against a wall panel until the form is ready for removal, after which the brackets may be removed without need for manual operations on the outside of the building.

Another important advantage of the invention is that the supporting members of the wall brackets may be installed from within the building, and in the preferred embodiments, the complete bracket structure may be installed from within the building, with greater safety and with accompanying savings in time and labor.

An additional advantage is that equipment requirements are reduced. In particular, simpler and less costly wall brackets are required. Moreover, the new wall brackets may be used with various forming systems, whereas different brackets presently are employed for different form systems, and the new brackets may be constructed for use with ranges of wall panel thickness.

A further advantage is that the method and means of the invention may be employed to support either an outside form wall alone, such as when successive wall panels are separated by a floor panel, or both outside and inside form walls, when successive wall panels are formed in abutting relation.

The foregoing and other advantages, objects and functions of the invention will be apparent on reference to the specification and to the attached drawings illustrating preferred embodiments of the invention.

BRIEF DESCRIPTION OF THE DRAWINGS

In the drawings, like elements are identified by like reference symbols in each of the views, and.

DESCRIPTION OF THE PREFERRED EMBODIMENTS

Figure 1:
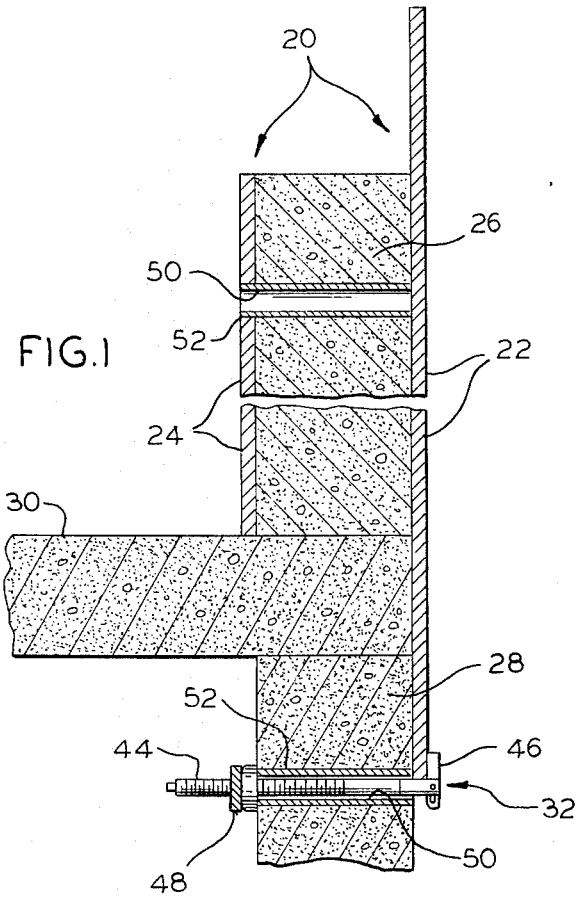
FIG. 1 is a fragmentary and broken vertical sectional view of two wall panels and a floor panel of a concrete building structure, a shear wall bracket, shown in side elevation, and an elevated concrete wall panel form, shown schematically, the form being supported in one manner pursuant to the invention.
Figure 2:
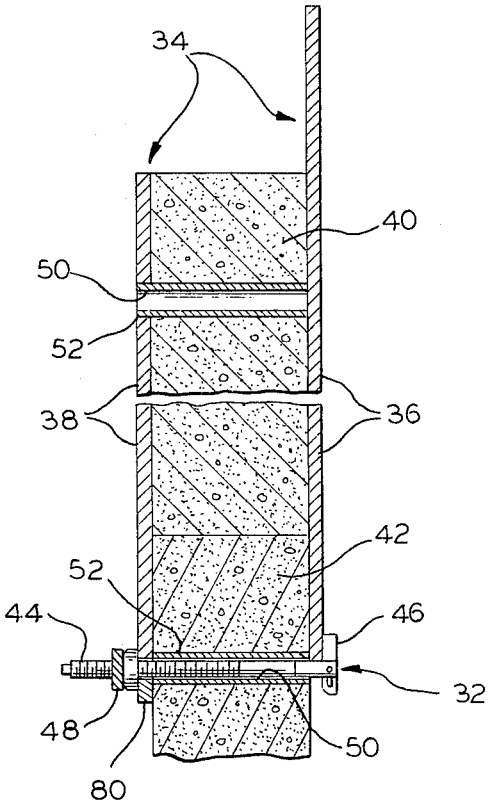
FIG. 2 is a view similar to FIG. 1 of two abutting wall panels of a building structure, the shear wall bracket of FIG. 1, and an elevated form supported in another manner pursuant to the invention.
Figure 3:
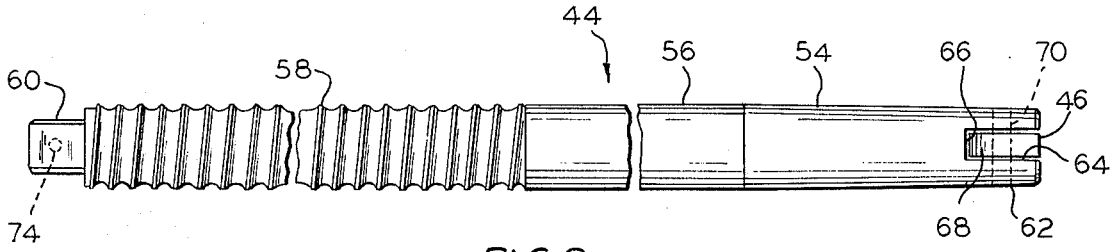
FIG. 3 is an enlarged broken top plan view of certain components of the shear wall bracket of FIG. 1.
Figure 4:
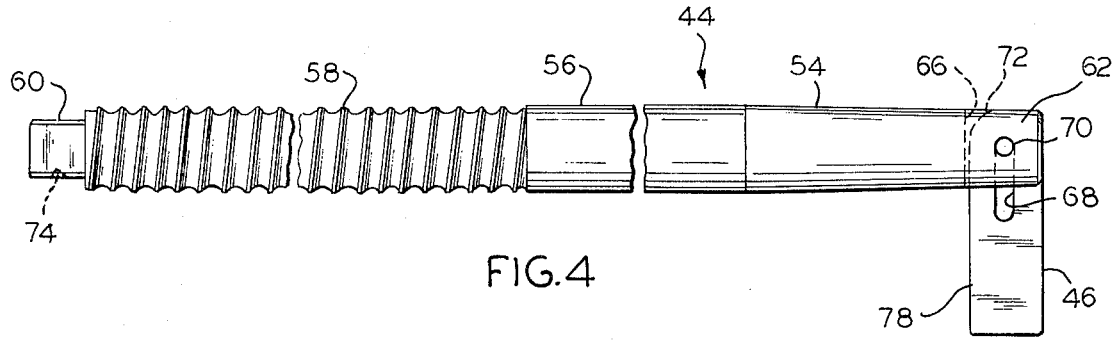
FIG. 4 is an enlarged broken side elevational view of the structure of FIG. 3.

Referring to the drawings, FIGS. 1 and 2 illustrate the support of elevated concrete wall panel forms in accordance with the invention. In FIG. 1, a form 20 having an outer form wall 22 and an inner form wall 24 is employed for forming a second concrete wall panel 26 in superposed relation to a first concrete wall panel 28, with the vertically extending wall panels separated by a horizontally extending floor panel or slab 30. In this manner of support, the outer form wall 22 is supported on a shear wall bracket 32 constructed in accordance with the invention. The bracket 32 in turn is supported by the first wall panel 28. The inner form wall 24 is supported on the floor panel 30 by conventional means, not shown. It will be understood that the form walls may be constructed in conventional ways, and erected in a gang of walls. For example, one type of form wall which may be employed is constructed of plywood panels framed by steel bars.

FIG. 2 illustrates a wall panel form 34 including an outer wall 36 and an inner wall 38. The form 34 is employed for forming a second concrete wall panel 40 in superposed abutting relation to a first concrete wall panel 42. In this manner of support, both the outer form wall 36 and the inner form wall 38 are supported on the bracket 32, in turn supported by the first wall panel 42.

Referring to FIGS. 1-5, the shear wall bracket 32 constituting a preferred embodiment of the invention includes a bolt member 44, a retaining member 46, and a nut member 48. The bracket 32 is a generally elongated structure constructed for inserting the bolt member 44 and the retaining member 46 thereof through a concrete wall panel to extend horizontally therethrough and project axially from opposite sides thereof. For this purpose, a generally cylindrical opening or hole 50 may be provided in a wall panel, such as one of the panels 26 and 28 illustrated in FIG. 1. The opening 50 may be defined by a tube 52 embedded in a wall panel. The tube 52 may be formed of any suitable material, such as rubber, sheet metal, or plastic, supported by a mandrel during pouring of the concrete, if necessary. Alternatively, the hole 50 may be provided by drilling through the wall panel after forming, without need for the tube 52. It will be understood that while but one opening 50 is illustrated for each of the wall panels 26 and 28, at least two openings 50 in horizontal alignment, with corresponding brackets 32, must be provided to support the outer form wall 22, and a plurality of aligned openings 50 may be provided in each wall panel, as circumstances require.

The bolt member 44 of the shear wall bracket 32 is constructed successively of a slightly tapered, normally outer, frusto-conical end section 54, an integral cylindrical section 56, an integral cylindrically threaded section 58, and an integral, normally inner terminal square stub section 60. The tapered end section 54 includes a terminal bifurcated portion 62 defining a generally rectangular slot 64 extending diametrically through the end section. The slot 64 is bordered by a transverse flat inner end wall 66.

The retaining member 46 is in the form of a generally rectangular bar having a rounded or radiused corner 72. It is mounted loosely in the slot 64 of the bolt member 44 for pivotal and sliding movement with respect to the bolt member. For this purpose, the retaining member is provided with a closed elongated slot 68 extending longitudinally and adjacent one end thereof. A pivot pin 70 is secured in the bifurcated portion 62 of the bolt member 44. The pin 70 extends through the slot 64, diametrically of the tapered end section 54, and through the retaining member slot 68, to hold the retaining member captive on the corresponding end of the bolt member 44.

The width of the retaining member 46 is approximately equal to the diameter of the tapered end section 54 of the bolt member 44 where the retaining member is mounted, and in any event, is less than the inside diameter of the wall panel opening 50. The length of the retaining member is such as to form a suitable clamp or stop for securing a form wall in place, with the form wall seated on the tapered end section 54 of the bolt member 44, as described hereinafter. The length of the retaining member slot 68 is such as to cause the retaining member to be held in place by engagement with the bolt member 44 when a form wall is supported, also as subsequently described. The rounded corner 72 of the retaining member 46 affords clearance for pivotal movement thereof.

The threaded section 54 of the bolt member 44 preferably is constructed with a contour or rolled thread, and it threadedly engages the nut member 48. The nut member 48 preferably is a knurled nut having a wide base, and it may be tightened and loosened on the bolt member 44 rapidly by hand. The bolt member 44, and particularly the threaded section 58 thereof, preferably is constructed in a length suitable for accommodating a range of thicknesses of the wall panels 26, 28, 40 and 42.

The stub section 60 provides a convenient means for engaging a tool to apply torque for turning or rotating the bolt member 44, with the consequences described hereinafter. An indent 74 forms an indicator mark on one surface of the stub section 60 serving to indicate the desired operative position of the bolt member 44.

The bolt member 44 of FIGS. 1-5 is adapted to be removably inserted through the panel opening 50, and the captive retaining member 46 is adapted to be removably inserted therewith, the assembly of the two being inserted from what is normally the inside of the building structure. The bolt member 44 is adapted for rotative movement about its axis when so inserted. The bolt member 44 when so inserted includes one projecting end, the tapered end 54 section, which is adapted for seating thereon the outer form wall 22 or 36, and an opposite projecting access end, including the outer end of the threaded section 58 and the stub section 60, adapted for threadedly engaging the nut member 48.

Figure 8:
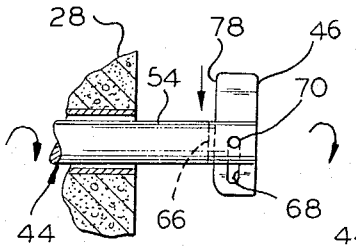
Figure 6:
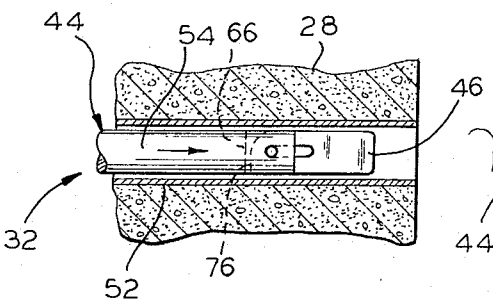
Figure 5:
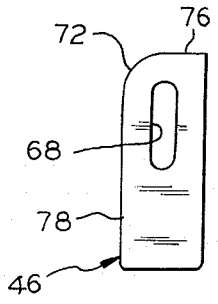
FIG. 5 is an enlarged side elevational view of a retaining member in the structure of FIG. 3.

Referring to FIGS. 6-9, the retaining member 46 is mounted on the bolt member 44 for pivotal and sliding movement between a position in which the retaining member is in substantial longitudinal alignment or register with the bolt member, as illustrated in FIG. 6, and a position in which the retaining member projects laterally from the bolt member and is adapted for being disposed in spaced relation to the supporting wall panel 28, as illustrated in FIG. 8, for securing a form wall therebetween, as illustrated for the outer form wall 22 in FIG. 1. When in their aligned positions, the bolt member 44 and the retaining member 46 may be inserted and withdrawn together through the supporting wall panel 28 and from the inner end of the bolt member, as illustrated for the respective directions of movement in FIGS. 6 and 9, the latter view illustrating the retaining member being moved into alignment with the bolt member.

The retaining member 46 is moved between its aforesaid positions by rotative or turning movement of the bolt member 44. A preferred manner of operation is illustrated in FIGS. 6–9. With the bolt member oriented as illustrated in FIG. 6 (the indicator mark 74 shown in FIG. 3 then facing upwardly) the retaining member 46 is positioned so that the flat end surface 76 adjacent the rounded corner 72 of the retaining member is in engagement with the end wall 66 bordering the slot 64 in the bifurcated portion 62. The retaining member 46 then is supported by the bolt member 44 in longitudinal alignment of the two members.

Figure 7:
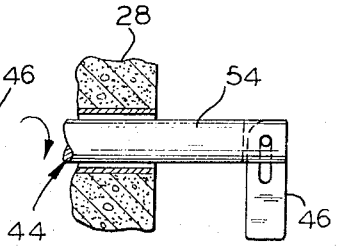

When the bolt member 44 is pushed through the opening 50 in the wall panel 28, and the rotated 180° as illustrated in FIG. 7, the retaining member 46 pivots under the force of gravity and hangs downwardly from the pivot pin 70, with its longitudinal axis generally perpendicular to the axis of the bolt member 44. Alternatively, the same result may be achieved by moving the bolt member 44 and the retaining member 46 through the opening 50 with the members rotated at 180° to the positions illustrated in FIG. 6, and the retaining member 46 will simply drop down when it leaves the opening 50, to assume the position of FIG. 7. A possible disadvantage of this technique is that since the retaining member 46 is unsupported by the bolt member 44 during its passage through the opening 50, it will be scraping the bottom of the tube 52 defining the opening, or the wall of the opening however formed, which may cause interference.

After reaching the position of FIG. 7, the bolt member 44 is rotated 180°, whereupon the retaining member 46 under the force of gravity falls in the direction of its longitudinal axis to the position illustrated in FIG. 8, owing to the sliding connection afforded by the pivot pin 70 in the longitudinal slot 68 of the retaining member. At this time, the retaining member 46 is in its laterally projecting position, and the bolt member 44 and the retaining member 46 are adapted for interengagement to prevent substantial pivotal movement of the retaining member, thereby holding the retaining member in place. Thus, the flat side surface 78 adjacent the rounded corner 72 on the retaining member 46 is disposed for engagement with the end wall 66 in the bifurcated portion 62 of the bolt member 44, to prevent rotation of the retaining member 46 in either direction about the pivot pin 70.

Figure 9:
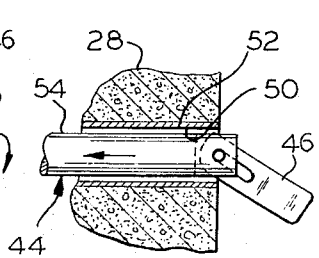
FIGS. 6 through 9 are diagrammatic views of a wall panel such as illustrated in FIG. 1, shown fragmentarily and in vertical section, and one end of the shear wall bracket of FIG. 1, illustrating manipulation of the bracket in use.

The retaining member 46 may be returned to its position of substantial alignment with the bolt member 44, by first rotating the bolt member 180° from its disposition illustrated in FIG. 8. Upon rotation, the retaining member 46 falls to its position illustrated in FIG. 7, in which the retaining member and the bolt member 44 are released from their interengagement of FIG. 8, to permit pivotal movement of the retaining member into alignment with the bolt member. Such alignment is accomplished as illustrated in FIG. 9, by withdrawing the bolt member 44 from the opening 50 in the wall panel 28 from the inner end of the bolt member as represented by its stud section 60. The retaining member 46 then is moved or cammed into the aligned position by contact with the outer rim of the opening 50, represented by the outer edge of the tube 52 in the illustrative embodiment. In this manner, the entire bracket 32 may be removed from the first wall panel 28.

Figure 11:
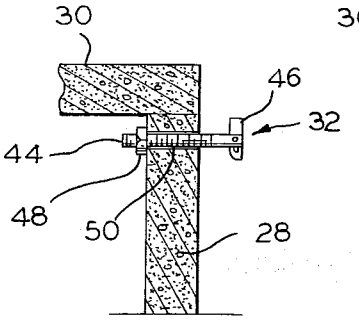
Figure 10:
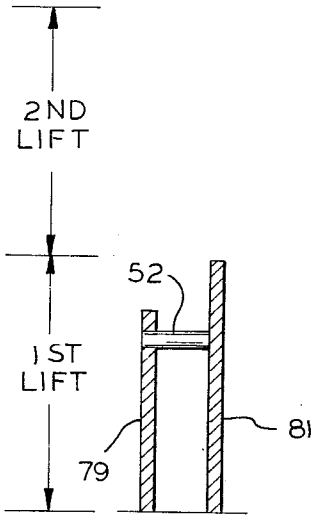

Referring to FIGS. 10–14, the sequence of operations in forming the walls of a building commences with the erection of inner and outer form walls 79 and 81, respectively, which may be at ground level. A tube 52 is supported adjacent the upper ends of the walls, and concrete is poured to form the first wall panel 28. A floor panel 30 is formed on the wall panel 28, as illustrated in FIG. 11. A bracket 32 then is mounted in the opening 50 defined by the tube 52, employing the technique illustrated in FIGS. 6–8.

Figure 12:
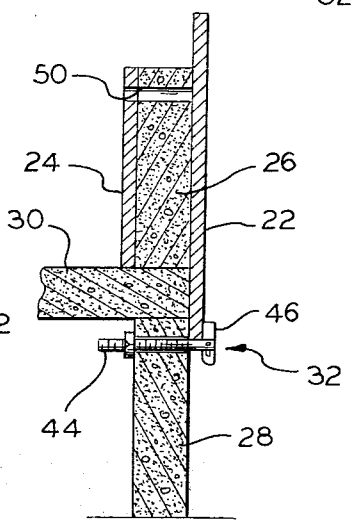

The bolt member 44 of the bracket 32 is pushed outwardly a sufficient distance from the first wall panel 28, e.g., 5 to 6 inches with certain types of form wall, to permit the seating of the lower end of a form wall 22 for the second wall panel 26 on the outwardly projecting end section 54 of the bolt member. The bolt member 44 then is pulled inwardly to clamp the form wall 22 against the first wall panel 28, as illustrated in FIG. 12, tightening the nut member 48 for this purpose. The retaining member 46 securely holds the form wall against the outer surface of the first wall panel.

In the construction method illustrated in FIGS. 1 and 10–14, the nut member 48 is tightened against the inner surface of the first wall panel 28, and the inner form wall 24 is supported on the floor panel 30. In the method illustrated in FIG. 2, the inner form wall 38 is seated on the inner, threaded end of the bolt member 44, and the nut member 48 is tightened against the inner form wall. To balance the application of force, a block 80 of suitable material and of the same thickness as the form wall 38 may be inserted beneath the bolt member 44 and between the nut member 48 and the first wall panel 42.

As illustrated in FIG. 1, a tube 52 is mounted to extend through the inner form wall 24 and to the outer form wall 22, to provide an opening 50 at a desired location in the second wall panel 26 to be formed. Conventional ties, not illustrated, are emplaced to extend between the respective inner and outer form walls, and concrete is poured to form the second wall panel 26. A second floor panel 82, illustrated in FIG. 13, may be poured.

Figure 14:
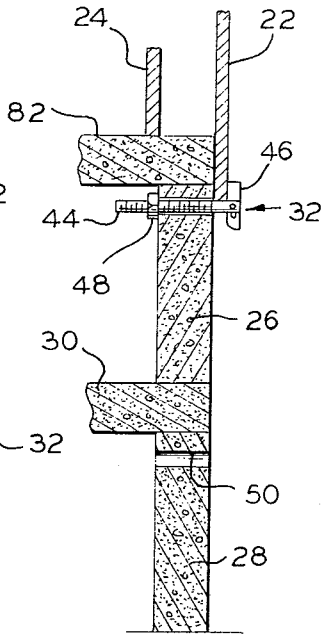
FIGS. 10 through 14 are diagrammatic views, in vertical section, illustrating successive steps in the erection of a building structure of the type illustrated in FIG. 1.
Figure 13:
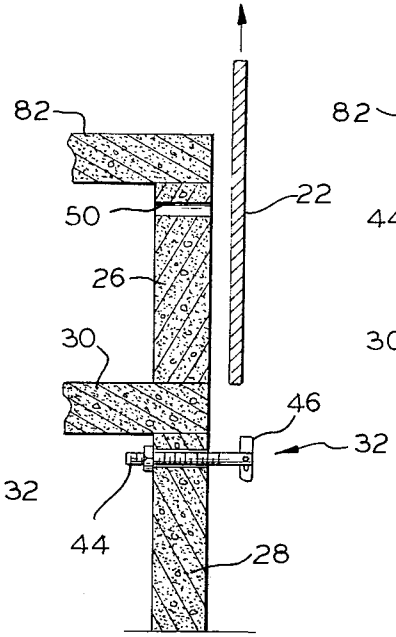

When it is time to remove the outer form wall 22, it may be removed with maximum safety. Thus, workmen on the form wall 22 or on scaffolding associated therewith may break back the form ties, and then may get off of the form wall, while the form wall is connected to crane cables and also remains supported on the brackets 32. The nut member 48 then is loosened and the bolt member 44 driven outwardly, as illustrated in FIG. 13, to release the outer form wall 22, which then may be raised to the third lift for reuse, as illustrated in FIG. 14. The inner form wall 24 is removed and raised to the third lift in any convenient manner. Likewise, the inner form wall 38 employed in the construction method of FIG. 2 may be removed and reinstalled in a successive lift in any convenient manner.

After removing the form walls from the second lift, the brackets 32 are removed from the first wall panel 28 and inserted in openings 50 in the second wall panel 26 for supporting the outer form wall 22 during the formation of a successive third wall panel, in the manner illustrated in FIG. 14. The operation may be repeated safely and efficiently for the formation of successive wall panels of whatever elevation. The openings 50 remaining in the wall panels 26 and 28 ultimately may be filled with grout or the like.

Figure 15:
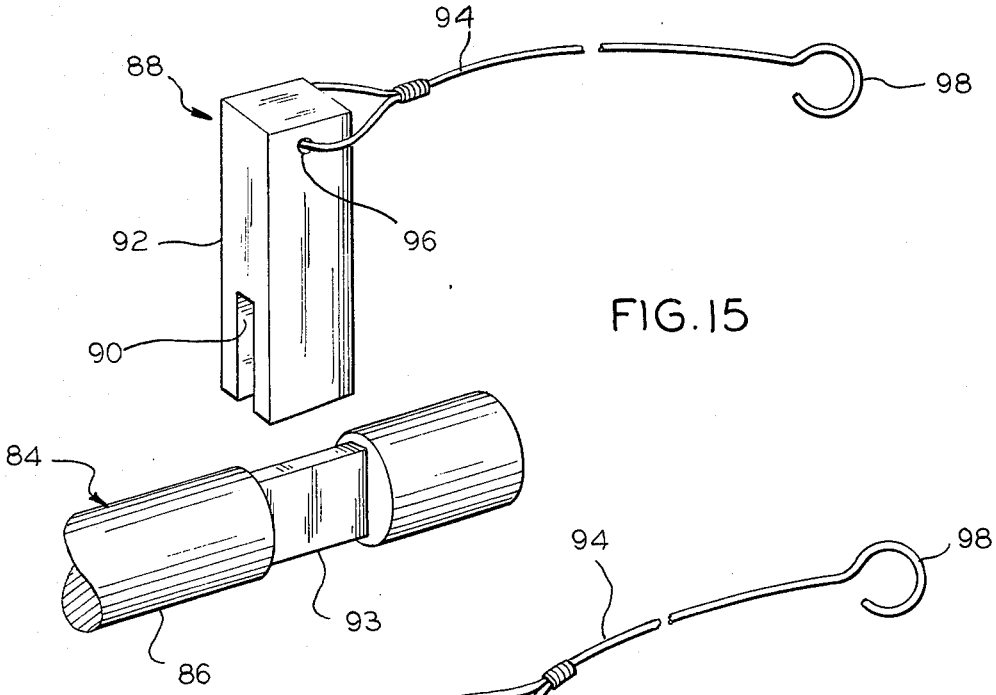
FIG. 15 is a fragmentary perspective view of a second form of shear wall bracket according to the invention, including a bolt member, one end of which is illustrated, and a retaining member, shown removed from the bolt member.
Figure 16:
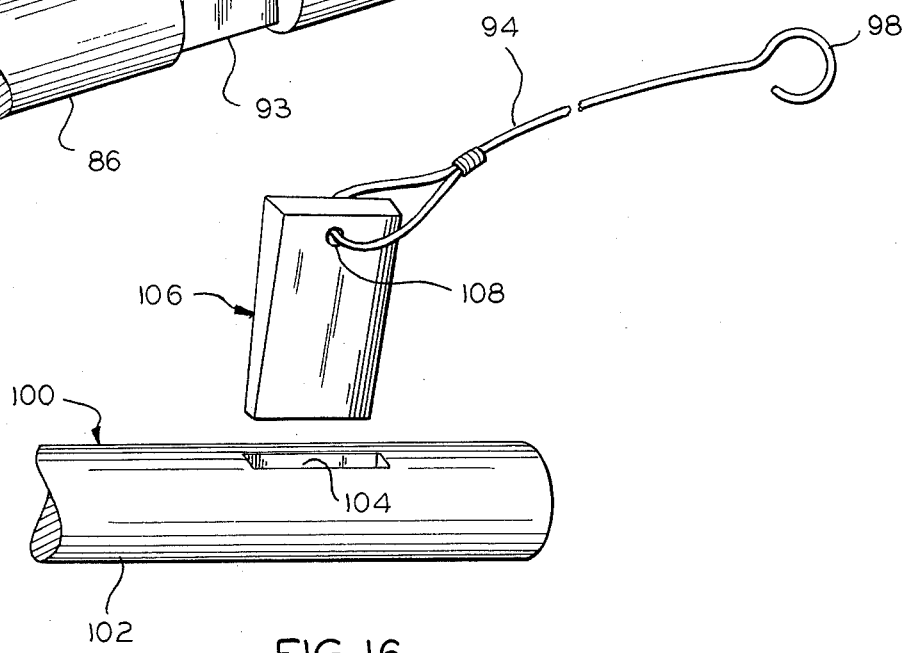
FIG. 16 is a fragmentary perspective view of a third form of shear wall bracket according to the invention, including a bolt member, one end of which is illustrated, and a retaining member, shown removed from the bolt member.
Figure 17:
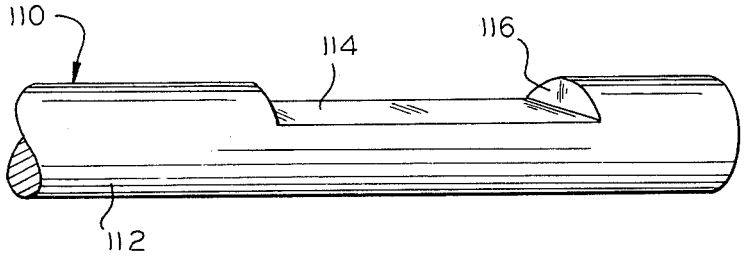
FIG. 17 is a fragmentary perspective view of a fourth form of shear wall bracket according to the invention, including a bolt member, one end of which is illustrated, and a retaining member in the form of an integral shoulder on the bolt member.

FIGS. 15–17 illustrate additional novel shear wall brackets which may be employed in the method of the invention for supporting an elevated concrete wall panel form. In FIG. 15, a bolt member 84 is illustrated fragmentarily, only a portion of one end section 86 being shown. The illustrative end section 86 is generally cylindrical, but it may be tapered as in the first bolt member 44. The bolt member 84 is completed like the bolt member 44 illustrated in FIGS. 1–5, with successive sections like the cylindrical section 56, the threaded section 58, and the stud section 60 having an indent 74. The bolt member 84 likewise is employed with a nut member 48.

The bracket of FIG. 15 includes a retaining member 88 which is adapted for being removably seated on the end section 88 of the bolt member. Thus, the retaining member 88 is U-shaped, and it includes a longitudinal rectangular slot 90 and a rectangular body 92. A portion of the end section 86 spaced from the end of the bolt member 84 is reduced to the configuration of a bar section 93 dimensioned similarly to the slot 90 of the retaining member 88 and loosely received therein. The retaining member 88 when seated on the bar section 93 engages the bolt member 84 for limited relative longitudinal movement between the members, with the retaining member projecting laterally from the bolt member. The retaining member 88 then is adapted for being disposed in spaced relation to a first wall panel, such as the panel 28, similarly to the retaining member 46 in the embodiment of FIGS. 1–5, for securing an outer form wall, such as the wall 22 or 36, therebetween.

Employing the shear wall bracket of FIG. 15, it is necessary to seat the retaining member 88 on the bolt member 84 after the bolt member is inserted through an opening 50 in a wall panel. However, this is not a difficult operation as compared with the prior mounting of an external wall bracket. Thereafter, an outer form wall, such as the wall 22 or 36, is seated on the end section 86, inwardly of the retaining member 88, and clamped by the retaining member against a wall panel, as with the first bracket 32. A second wall panel then is formed, as when the first bracket 32 is used.

To facilitate removing the retaining member 88 after forming a second or successive wall panel, a lanyard 94 is joined to the retaining member 88, being inserted through a transverse opening 96 therein. The lanyard 94 terminates in a hook 98, which may be connected to a structural member or other connecting means (not shown) on the outer form wall, such as the wall 22 or 36. When the outer form wall is lifted, as illustrated for the wall 22 in FIG. 13, it serves to lift the retaining member 88 off of the bolt member 84, after which the bolt member may be withdrawn through the first wall panel, such as the panel 28, and inserted through an opening 50 in the second wall panel, such as the panel 26. Alternatively, but less desirably, the retaining member 88 may be removed by a workman on the outer form wall, after driving the bolt member 84 outwardly and prior to lifting the form wall.

FIG. 16 illustrates a third form of a shear wall bracket, which is in all respects like the form of FIG. 15, with the exception that the bolt member 100 thereof is provided in one end section 102 with a wedge-shaped opening 104 therethrough in spaced relation to the end of the bolt member, and a wedge-shaped retaining member 106 is employed. The illustrative end section 102 is generally cylindrical, but it may be tapered as in the first bolt member 44. A lanyard 94 is connected to the retaining member, being inserted through an opening 108 therethrough. As in the preceeding brackets, the retaining member 106 serves to clamp an outer form wall, such as the wall 22 or 36, to a first wall panel, such as the panel 28, for forming a second wall panel, such as the panel 26.

As with the bracket of FIG. 15, the bolt member 100 is inserted through an opening 50 in a wall panel, after which the retaining member 106 is seated on the bolt member. The retaining member 106 is received in the wedge-shaped opening 104, thereby engaging the bolt member for limited relative longitudinal movement between the members. The retaining member 106 projects laterally from the bolt member and is adapted for being disposed in spaced relation to a first wall panel for securing therebetween a form wall seated on the end section 102. The lanyard 94 is adapted for connection to the form wall for removal of the retaining member 106 from the bolt member by elevation of the form wall. Alternatively, but again less desirably, the retaining member 106 may be removed after forming a second wall panel, by a workman on the outer form wall, after driving the bolt member 100 outwardly and prior to lifting the form wall.

The fourth form of shear wall bracket illustrated in FIG. 17 includes a bolt member 110 having an end section 112 which is generally cylindrical or may be tapered towards its outer end. The bolt member 110, like the bolt members 84 and 100 of the brackets of FIGS. 15 and 16, is completed by successive sections like the cylindrical section 56, the threaded section 58, and the stud section 60 bearing the indent 74 of the bracket of FIGS. 1–5.

The end section 112 is recessed to provide a ledge or flat 114 and an integral retaining shoulder 116 at the outer end of the ledge and spaced from the outer end of the end section 112. The ledge 114 is adapted for seating an outer form wall, such as the wall 22 or 36, thereon. The retaining shoulder 116 is adapted for being disposed in spaced relation to a first wall panel, such as the panel, 28 for securing the form wall therebetween.

The bracket of FIG. 17 is employed by inserting the bolt member 110 through a wall panel opening 50, seating an outer form wall, such as the wall 22 or 36, on the ledge 114, and moving the bolt member 110 inwardly to clamp the form wall between the wall panel and the retaining shoulder 116. After forming a second wall panel, such as the panel 26, the bolt member 110 is driven outwardly, in the manner illustrated for the bracket 32 in FIG. 13, after which the outer form wall is lifted away from the bolt member. The bolt member 110 then may be withdrawn through the wall panel opening 50 and inserted in an opening 50 in the next successive wall panel. The bolt member 110 is limited in the extent to which the retaining shoulder 116 may project while retaining adequate shear strength in the bolt member and an acceptable bolt diameter.

Another structure which may be employed within the broad scope of the method and support means of the invention, but less advantageously than the foregoing brackets, is a shear bracket similar to the bracket 32 but having the outer end section 54 of the first bolt member 44 replaced by a cylindrical end section which is threaded for receiving a relatively wide nut member, such as the nut member 48. After the corresponding bolt member is inserted through a wall panel opening 50, a nut member must be threaded on the outer end of the bolt member. However, this is considerably less difficult than mounting an external bracket, following the prior practices. Also, the nut member must be removed manually after a wall panel is formed. This may be done while an outer form wall remains supported on the bolt member, but is less desirable.

The invention thus provides a method and means for supporting an elevated concrete wall panel form which are employed with increased safety and efficiency. A shear wall bracket is mounted readily on a wall panel for supporting a form thereabove. The form is supported safely on bolt members while workmen are working on the form and until they get off of the form. The bolt members then are removed from inside the structure safely and without having to work on the outside of the structure.

While certain preferred embodiments of the invention have been described and illustrated, it will be apparent to those skilled in the art that various changes and modifications may be made therein within the spirit and scope of the invention. It is intended that all such changes and modifications be included within the scope of the appended claims.

Having thus described the invention, what I claim as new and desire to secure by Letters Patent is:

1. In combination with a wall of an elevated concrete wall panel form, support means therefor which comprises:

a first concrete wall panel having an opening extending horizontally therethrough, a bolt member removably inserted through said opening and projecting axially from opposite sides of said first wall panel and adapted for rotative movement about its axis, said form wall being seated on one projecting end of said bolt member for use in forming a second concrete wall panel in superposed relation to said first wall panel, the opposite end of said bolt member being accessible, said form wall having a lower edge abutting on said one end of the bolt member for vertically removably seating the form wall thereon, a retaining member captive on said one end of the bolt member, and means mounting said retaining member on said bolt member for movement thereon between a position in which the retaining member is in substantial longitudinal alignment with the bolt member and a position in which the retaining member projects laterally from the bolt member, said retaining member being moved between said positions by rotative movement of said bolt member and gravitational force, said bolt member and said retaining member when in said aligned position being movable for insertion and withdrawal together through said first wall panel and from said opposite end of the bolt member, said retaining member being disposed in said laterally projecting position in spaced relation to said first wall panel and clamping said form wall therebetween, whereby said form wall may be vertically removed from its seat on said bolt member after forming said second wall panel and before withdrawing said bolt member, and thereafter said withdrawal of the bolt member may be effected.

2. A combination as defined in claim 1 and including a nut threadedly engaging said opposite end of the bolt member to clamp said form wall.

3. A combination as defined in claim 1 and wherein said retaining member is mounted for pivotal and sliding movement between said positions, said bolt member when in one rotative position thereof being adapted for engaging said retaining member in said laterally projecting position to prevent substantial pivotal movement of the retaining member and thereby hold the retaining member in place, and said retaining member when in another rotative position of said bolt member being automatically released from said engagement to permit pivotal movement of the retaining member into said aligned position.

4. A combination as defined in claim 3 and including a nut threadedly engaging said opposite end of the bolt member to clamp said form wall.

5. In combination with a wall of an elevated concrete wall panel form, support means therefor which comprises:

a first concrete wall panel having an opening extending horizontally therethrough, a bolt member removably inserted through said opening and projecting axially from opposite sides of said first wall panel, said form wall being seated on one projecting end of said bolt member for use in forming a second concrete wall panel in superposed relation to said first wall panel, the opposite end of said bolt member being accessible, said form wall having a lower edge abutting on said one end of the bolt member for vertically removably seating the form wall thereon, and a retaining member projecting laterally from said one end of the bolt member in spaced relation to said first wall panel and clamping said form wall therebetween, said retaining member being mounted on said bolt member for disposition permitting withdrawal of the bolt member through said first wall panel and from said opposite end of the bolt member, whereby said form wall may be vertically removed from its seat on said bolt member after forming said second wall panel and before withdrawing said bolt member, and thereafter said withdrawal of the bolt member may be effected.

6. A combination as defined in claim 5 and including a nut threadedly engaging said opposite end of the bolt member to clamp said form wall.

7. A method of supporting and removing an elevated concrete wall panel form which comprises:

a. removably inserting a bolt member through a first concrete wall panel to extend horizontally therethrough, said panel having opposite near and far sides and said bolt member being inserted from said near side to cause one end of the bolt member to project axially outwardly from said far side for supporting a load adjacent thereto, and to cause the opposite end of the bolt member to project axially outwardly from said near side for access to the bolt member, b. subsequently lowering from above a wall of a form for use in forming a second concrete wall panel in superposed relation to said first wall panel, said form wall being lowered into abutment of its lower edge on said one end of the bolt member for vertically removably seating the form wall thereon, c. providing a retaining member on said one end of the bolt member in a position projecting laterally outwardly therefrom with said form wall disposed between the retaining member and said first wall panel, said retaining member being mounted on said bolt member for disposition permitting withdrawal of the bolt member through said first wall panel and from said opposite end of the bolt member, d. pulling said bolt member from said opposite end thereof to clamp said form wall between said first wall panel and said retaining member for forming said second wall panel, e. vertically removing said form wall from its seat after forming said second wall panel and before withdrawing said bolt member, f. disposing said retaining member so as to permit withdrawal of said bolt member in said manner, and g. thereafter withdrawing said bolt member in said manner.

8. A method as defined in claim 7 wherein said form wall is clamped by tightening a nut in threaded engagement with said opposite end of the bolt member.

9. A method as defined in claim 8 wherein said bolt member is adapted for rotative movement about its axis, said retaining member is mounted captively on said one end of the bolt member for pivotal and sliding movement between a position in which the retaining member is in substantial longitudinal alignment with the bolt member and said laterally projecting position, said bolt member and said retaining member when in said aligned position being movable for insertion and withdrawal together through said first wall panel, said retaining member being moved between said positions by rotative movement of said bolt member and gravitational force, said bolt member when in one rotative position thereof being adapted for engaging said retaining member in said laterally projecting position to prevent substantial pivotal movement of the retaining member and thereby hold the retaining member in place, and said retaining member when in another rotative position of said bolt member being automatically released from said engagement to permit pivotal movement of the retaining member into said aligned position.

* * * * *